US005362333A

United States Patent [19]

Yoshitake et al.

[11] Patent Number: 5,362,333

[45] Date of Patent: Nov. 8, 1994

[54] PRETREATMENT FOR ZINC AND ZINC ALLOY PRIOR TO CHROMATING

[75] Inventors: Noriaki Yoshitake; Kensuke Mizuno; Hitoshi Ishii, all of Hiratsuka, Japan

[73] Assignee: Henkel Corporation, Plymouth Meeting, Pa.

[21] Appl. No.: 39,255

[22] PCT Filed: Oct. 9, 1991

[86] PCT No.: PCT/US91/07586

§ 371 Date: Apr. 15, 1993

§ 102(e) Date: Apr. 15, 1993

[30] Foreign Application Priority Data

Oct. 15, 1990 [JP] Japan ..... 2-275837

[51] Int. Cl.[5] ..... C23C 22/78

[52] U.S. Cl. ..... 148/264; 148/255; 148/261

[58] Field of Search ..... 148/255, 264, 261

[56] References Cited

FOREIGN PATENT DOCUMENTS

| | | |
|---|---|---|
| 235297 | 9/1987 | European Pat. Off. . |
| 177381 | 10/1984 | Japan . |
| 59-177381 | 10/1984 | Japan . |
| 61-069978 | 4/1986 | Japan . |
| 189630 | 4/1986 | Japan . |
| 52-43171 | 4/1987 | Japan . |
| 5222618 | 6/1987 | Japan . |

*Primary Examiner*—Sam Silverberg

*Attorney, Agent, or Firm*—Ernest G. Szoke; Wayne C. Jaeschke; Novell E. Wisdom, Jr.

[57] ABSTRACT

Drying into place a covering of an aqueous solution of nickel and/or cobaltous sulfate and/or phosphate salts on a zinc or zinc alloy surface improves at least one of the blackening resistance and corrosion resistance after subsequent chromating treatment and the corrosion resistance and paint adherence after subsequent chromating treatment and painting.

8 Claims, No Drawings

PRETREATMENT FOR ZINC AND ZINC ALLOY PRIOR TO CHROMATING

TECHNICAL FIELD

The present invention relates to a method for treating zinc and zinc alloy surfaces. In the description below, except where the context requires otherwise, the term "zinc" when used to describe surfaces to be treated is to be understood as including alloys that are predominantly zinc. More particularly, the present invention relates to a method for treating a surface of zinc-plated or zinc alloy-plated steel, prior to a chromating treatment, to provide corrosion resistance and/or function as a paint undercoat.

BACKGROUND ART

Sacrificial anodic protection based on zinc plating or zinc alloy plating is the most effective and most economical method for the corrosion protection of iron and steel. As a consequence, galvanized steel sheet accounts for 10 million tons or 10% of Japan's annual raw steel output of 100 million tons. Galvanized steel sheet is widely employed for building materials, automobiles, household electrical appliances, and the like.

In sacrificial anodic protection by zinc, the two metals (zinc and iron or steel) are in contact and form an electrochemical cell, and the zinc, as the baser metal, becomes the anode and renders the iron cathodic. This inhibits corrosion of the iron or steel by preventing the anodic dissolution which would occur in the case of iron by itself due to local cell formation. Accordingly, when the zinc in contact with the iron or steel has finally been consumed, the anticorrosion activity disappears. Therefore, preventing corrosion of the zinc layer itself (generally white rust corrosion) is crucial for extending the durability of galvanized steel material, and to this end galvanized steel is normally chromated as an undercoating treatment and then painted.

However, these two anticorrosion treatments (chromate treatment and painting) suffer from certain problems. Thus, while the chromate treatment of zinc-plated steel sheet or zinc alloy-plated steel sheet results in a very substantial inhibition of white rust development, this treatment can cause the development of black rust (known as "blackening") during storage or transport of the galvanized steel sheet. It has been observed that this phenomenon tends to occur more readily in the case of a skin pass-rolling after zinc plating and more easily when several % aluminum is present in the zinc than for ordinary galvanized steel sheet.

On the other hand, there has been a substantial proliferation in metal materials in the sector concerned with the production of colored galvanized steel sheet (widely employed for roofing and siding) by painting zinc-plated steel sheet and zinc alloy-plated steel sheet, particularly in coil form. Because the available surface treatments with reactive phosphate salts have not been able to respond to these developments, coating-type chromate treatments, which can be applied to many types of materials, tend to be used for surface treatment. However, adherence by the paint film is a normal problem here, and a problematic paint film adherence is associated with the bending of galvanized steel sheet and particularly with the bending of ultralow-lead galvanized steel sheet and zinc/aluminum alloy-plated steel sheet.

Flash treatment with, e.g., Ni, Co, Fe, etc., as described, e.g., in Japanese Patent Publication Numbers 52-22,618 [22,618/77]and 52-43,171 [43,171/77]and Japanese Patent Application Laid Open [Kokai or Unexamined]Number 59-177,381 [177,381/84]) is considered at present to be a powerful countermeasure against both blackening after chromating and low paint adherence of painted galvanized steel sheet. Japanese Patent Publication Numbers 52-22,618 and 52-43,171 teach that an improved paint adherence is obtained through a substitutional plating treatment (executed prior to chromating) with an acidic solution (pH about 1.5) containing, e g., $Ni^{2+}$, $Co^{2+}$, $Fe^{2+}$, $Fe^{3+}$. In the examples provided therein, the substitutional plating treatment is immediately followed by a water rinse.

Japanese Patent Application Laid Open Number 59-177,381 teaches that blackening can be prevented through the treatment (executed prior to chromating) of zinc-plated or zinc alloy-plated steel sheet with a solution (pH=1–4 or 11–13.5) which contains $Ni^{2+}$or $Co^{2+}$. In the examples provided for this particular method, treatment with the Ni- or Co-containing solution is followed by rinsing with tap water. On the subject of the activity of the Ni or Co, it is hypothesized in this reference that black rusting is suppressed by their deposition as the metal or oxide.

Thus, as discussed above, it is already known that a pre-chromating flash treatment of the surface of zinc plating or zinc alloy plating with a transition metal such as Co, Fe, etc. will prevent black rusting on the chromated zinc plate or zinc alloy plate and improve the paint adherence to zinc-plated and zinc alloy-plated steel sheet.

The mechanisms by which the aforesaid Ni, Co, or Fe flash treatment inhibit the blackening of zinc-plated or zinc alloy-plated steel sheet and increase the paint/steel sheet bonding have not yet been established with certainty. However, according to the report on pages 150 to 151 of the Collected Summary of the 60*th Scientific General Lecture Meeting of Kinzoku Hyomen Gijutsu Kyokai* [The Metal Finishing Society of Japan], there is some type of interaction between the flashed metal and the chromium compound(s). This conclusion was drawn based on the observations that a large amount of flashed metal precipitates at the grain boundaries of the zinc crystals and that the chromium provided by the follow-on coating-type chromate treatment is, like the flashed metal, distributed on the grain boundaries. It is conjectured in this reference that the chromium compound is adsorptively immobilized or fixed on the flashed metal.

Zinc black rust, like white rust, is thought to be a basic zinc carbonate as expressed by the chemical formula $(ZnCO_3)_x.[Zn(OH)_2]_y$, but it differs from white rust as a consequence of a stoichiometric oxygen deficiency. Accordingly, black rust is a corrosion product which develops under oxygen-deficient circumstances, and, in particular, it is thought to be formed accompanying the development of corrosion from the grain boundaries. Due to this, it is possible that the chromium compound (concentrated at the grain boundaries by the flashed metal) contributes to the inhibition of black rust development by inhibiting corrosion from the grain boundaries.

As to why flash treatment with a transition metal, e.g., Ni, Co, Fe, improves the paint adherence of galvanized steel sheet, it is thought that the interaction between the flashed metal and chromium compound(s)

serves adsorptively to fix or immobilize the chromium compound(s) on the zinc-plate surface. This strengthens the bonding forces between the zinc-plated surface of the material and the chromium compound(s), with the result that the zinc-plate surface/chromium compound interfacial bonding strength is improved. This particular interface is considered to be the weakest of all the interfaces between the various layers in a painted zinc surfaced object with a chromate undercoating.

As explained hereinbefore, a pre-chromating flash treatment with Ni, Co, Fe, etc., is a powerful countermeasure against both of the major problems associated with galvanized steel sheet (blackening and unsatisfactory paint adherence). Nevertheless, when a flash treatment is implemented prior to chromating, it is known that black rusting is in fact inhibited but that white rust tends to appear rather readily. In addition, although this flash treatment does improve the paint adherence to colored galvanized steel sheet during bending, it is known that it reduces the corrosion resistance of the painted sheet and particularly the corrosion resistance of the back-coat surface (service coat).

DESCRIPTION OF THE INVENTION

Problem to Be Solved by the Invention

A major object of this invention Was a method for treating zinc surfaces so that the development of black rust would be inhibited without sacrificing the white rusting resistance and the paint adherence during bending would be improved without diminishing the corrosion resistance of a subsequently painted sheet.

SUMMARY OF THE INVENTION

The major embodiment of the invention is a pretreatment method, to be implemented prior to the chromating of zinc or zinc alloy, which comprises the application to the zinc surface of an aqueous solution that comprises, more preferably consists essentially of, or still more preferably consists of, water, at least 1 selection from the sulfate and phosphate salts of $Ni^{2+}$and $Co^{2+}$, and, optionally, a complexing agent to stabilize the solution, followed by drying to give a film thereon, preferably with an add-on weight of 0.5–100 milligrams per square meter (hereinafter "mg/m$^2$). As a consequence of this pretreatment and the follow-on execution of a chromating treatment for the purposes of corrosion resistance or as a paint undercoat, the major object of the invention is achieved. For the purposes of this invention, the term "phosphate salts" is to be understood as including those salts in which the anions are $PO_4^{31\,3}$, $HPO_4^{-2}$, $H_2PO_4^{-}$, $P_2O_7^{-2}$, $HP_2O_7^{-}$, $PO_3^{-}$, or mixtures thereof.

Additional Description of the Invention

The aqueous solution (treatment solution) employed by the present invention must contain at least one of the metal ions $Ni^{2+}$and $Co^{2+}$, which must be supplied to the treatment solution as sulfate or phosphate salt.

Chlorides should be avoided in the treatment solution because they reduce the white rusting resistance, and the nitrate salts are not satisfactory alone because they lack any effect in terms of preventing black rust.

Otherwise, the treatment solution may optionally contain complexing agent in order to stabilize the treatment solution, and examples in this regard are gluconic acid and heptogluconic acid and their salts such as sodium gluconate and sodium heptogluconate.

The treatment method consists of the application of the treatment solution to the zinc or zinc alloy by any convenient coating method that provides adequate control of the evenness and amount of the coating applied, such as spray coating, immersion followed by roll squeegee, immersion followed by air knife, roll coating, and so forth. Roll coating is usually preferred. After coating, drying is conducted without any intervening water rinse.

The drying conditions are not specifically restricted, and a satisfactory drying is obtained merely by removing the water in the original coating. The sheet temperature preferably during drying falls within the range of 40°–100° C. Exceeding 100° C. does not accrue any increase in performance and so is economically disadvantageous.

The film weight bonded to the zinc or zinc alloy surface by the aforementioned treatment should preferably fall within the range of 0.5–100 mg/m$^2$. Values less than 0.5 mg/m$^2$ do not usually result in an adequate inhibition of black rusting and cannot generally be expected to result in an improved paint adherence when the purpose is service as a paint undercoat. On the other hand, the black rust inhibiting effectiveness and the improvement in paint adherence both fail to improve any further at values in excess of 100 mg/m$^2$, which makes such values economically disadvantageous.

The present invention will be illustrated in greater detail below through demonstrative and comparative examples. These examples are provided simply to promote appreciation of the present invention, and they do not restrict the present invention in any way.

EXAMPLES

Examples 1–6 Comparison Examples 1–4

The sample test sheet (specified below) was subjected to an alkaline degreasing, water rinse, drying, and then pretreatment according to the present invention or a comparison method. The sample test sheet (both pretreated and non-pretreated) was then subjected to a chromate treatment. Sample test sheets which had been subjected to these treatments were subsequently examined using the black rust accelerated testing and white rust accelerated testing described below.

The composition of the treatment solution, film weight, and the results for black rust accelerated testing and white rust accelerated testing are reported in Table 1.

(1) Sample test sheet: electrogalvanized steel sheet (oiled) zinc add-on=20 g/m$^2$ (2) Alkaline degreasing: 2% aqueous solution of weakly alkaline degreaser (PAL-KLIN TM 342 from Nihon Parkerizing Company, Limited) temperature=60° C., spray for 30 seconds (3) Water rinse: tap water spray, 10 seconds (4) Drying: forced draft drying (5) Pretreatment: The aqueous solution as reported in Table 1 was applied by roll coating to a wet add-on of 3 milliliters per square meter (hereinafter "mL/m$^2$").

(6) Drying: maximum sheet temperature=50° C., drying time=2 seconds (7) Chromate treatment: aqueous solution of partially reduced chromic anhydride as described in Japanese Patent Application Laid

TABLE 1

| | treatment solution composition (mole/L) | film weight ($mg/m^2$) | black rust accel-erated testing | white rust accel-erated testing |
|---|---|---|---|---|
| Example 1 | $NiSO_4$:0.006 | 2.8 | 5 | 5 |
| Example 2 | $CoSO_4$:0.09 | 41.8 | 5 | 5 |
| Example 3 | $Ni(H_2PO_4)_2$:0.10 | 75.8 | 5 | 5 |
| Example 4 | $CoSO_4$:0.01<br>$Co(H_2PO_4)_2$:0.02 | 19.8 | 5 | 5 |
| Example 5 | $NiSO_4$:0.03<br>heptogluconic acid:0.06 | 13.9 | 5 | 5 |
| Example 6 | $NiSO_4$:0.03<br>$CoSO_4$:0.02 | 23.2 | 5 | 5 |
| Comparison Example 1 | $NiCl_2$:0.05 | 19.5 | 4 | 1 |
| Comparison Example 2 | $Co(NO_3)_2$:0.01 | 5.5 | 2 | 4 |
| Comparison Example 3 | Japanese Patent Application Laid Open Number 59-177381. Example 1-d. (note 1) | (note 2) 2.5 | 5 | 2 |
| Comparison Example 4 | no pretreatment | — | 1 | 5 |

Note 1: Rinse with tap water after the cobalt treatment.
Note 2: Reported as the cobalt add-on.

Open Number 63-145785 [145,785/88](chromium weight ratio ($Cr^{3+}/Cr^{6+}$)=0.67, contained $H_3PO_4$ and acrylic polymer emulsion with a high compatibility and stability relative to chromic acid), roll coating, chromium add-on=45–50 $mg/m^2$ (resin film weight=1-80–200 $mg/m^2$)

(8) Drying: maximum sheet temperature=80° C., drying time=5 seconds (9) Black rust accelerated testing: Test specimens (70×150 millimeters {"mm"}) were cut from each sample test sheet. The test surfaces of the test specimens were faced against each other to give pairs. 5–10 pairs were stacked on one another and then wrapped with vinyl-coated paper. The four corners were bolted down and a load of 70 kilograms of force ("kgf") was applied using a torque wrench. The assembly was then maintained in a humidistat at 70° C. at a relative humidity ("RH") of 80% for 240 hours. After removal, blackening of the overlaid areas was visually evaluated and reported on the following evaluation scale:

5: no blackening
4: extremely light greying
3: blackening over <25%
2: blackening over 25 through <50%
1: blackening over at least 50%

(10) White rust accelerated testing: A test specimen (70×150 mm) was cut from each sample test sheet. This test specimen was subjected to the salt spray test specified in Japanese Industrial Standard ("JIS") Z 2371 for 200 hours. The area over which white rust developed was then visually evaluated and reported according to the following evaluation scale:

5: no white rust
4: area of white rust development <5%
3: area of white rust development=5 to <25%
2: area of white rust development=25 to <50%
1: area of white rust development at least 50%

Examples 7–12 and Comparison Examples 5–8

The sample test sheet (specified below) was subjected to pretreatment according to the present invention or a comparison method. The sample test sheets (both pretreated and non-pretreated) were then subjected to a chromate treatment. Sample test sheets which had been subjected to these treatments were subsequently examined using black rust accelerated testing and white rust accelerated testing as described below.

The composition of the treatment solution, film weight, and the results for black rust accelerated testing and white rust accelerated testing are reported in Table 2.

(1) Sample test sheet: Galfan TM (zinc/5% aluminum alloy-plated steel sheet), nonoiled zinc add-on=90 $g/m^2$elongation in skin pass-rolling=1.5%

(2) Pretreatment: immersion in the aqueous solution reported in Table 2 and then air-knife squeegee to a wet pick-up of 5 $mL/m^2$ (3 ) Drying: maximum sheet temperature=60° C., drying time=3 seconds (4) Chromate treatment: aqueous partially reduced chromic anhydride solution (chromium weight ratio ($Cr^{3+}/Cr^{6+}$)=0.25), applied by roll coating to give a chromium add-on of 10–15 $mg/m^2$

TABLE 2

| | treatment solution composition (mole/L) | film weight ($mg/m^2$) | black rust accel-erated testing | white rust accel-erated testing |
|---|---|---|---|---|
| Example 7 | $NiSO_4$:0.05 | 38.7 | 5 | 5 |
| Example 8 | $CoSO_4$:0.01 | 7.7 | 5 | 5 |
| Example 9 | $Co(H_2PO_4)_2$:0.07 | 88.5 | 5 | 5 |
| Example 10 | $NiSO_4$:0.005<br>$Ni(H_2PO_4)_2$:0.005 | 10.2 | 5 | 5 |
| Example 11 | $CoSO_4$:0.02<br>sodium gluconate:0.02 | 15.5 | 5 | 5 |
| Example 12 | $NiSO_4$:0.005<br>$CoSO_4$:0.01 | 11.6 | 5 | 5 |
| Comparison Example 5 | $NiCl_2$:0.01 | 6.5 | 3 | 1 |
| Comparison Example 6 | $Co(NO_3)_2$:0.03 | 27.4 | 2 | 4 |
| Comparison Example 7 | Japanese Patent Application Laid Open Number 59-177381. Example 1-d. (note 1) | (note 2) 5.2 | 5 | 1 |
| Comparison Example 8 | no pretreatment | — | 1 | 5 |

Note 1: Rinse with tap water after the cobalt treatment.
Note 2: Reported as the cobalt add-on.

(5) Drying: maximum sheet temperature=60° C., drying time=3 seconds (6) Black rust accelerated testing: Test specimens (70×150mm) were cut from each sample test sheet. The test surfaces of the test specimens were faced against each other to give pairs. 5–10 pairs were stacked on one another and then wrapped with vinyl-coated paper. The four corners were bolted down and a load of 70 kgf was applied using a torque wrench. The assembly was then maintained in a humidistat at 49° C. and 98 % RH for 240 hours. After removal, blackening of the overlaid areas was visually evaluated according to the following evaluation scale:

5: no blackening

4: extremely light greying
3: blackening over <25%
2: blackening over 25 through <50%
1: blackening over at least 50%

(7) White rust accelerated testing: A test specimen (70×150 mm) was cut from each sample test sheet. This test specimen was subjected to the salt-spray test specified in JIS-Z 2371 for 120 hours. The area over which white rust developed was then visually evaluated and reported according to the following evaluation scale:
5: no white rust
4: area of white rust development <5%
3: area of white rust development=5 to <25%
2: area of white rust development=25 to <50%
1: area of white rust development at least 50%

Examples 13–18 and Comparison Examples 9–12

The sample test sheet (specified below) was subjected to pretreatment according to the present invention or a comparison method. The sample test sheet (both pretreated and non-pretreated) was then subjected to a chromate treatment. The results of bending testing (see below) and corrosion testing on the painted sheet are reported in Table 3 for the sample test sheets which had been subjected to these treatments.

(1) Sample test sheet: ultralow lead hot-dip-galvanized steel sheet (Pb=0.003%), nonoiled zinc add-on=90 g/m$^2$
(2) Pretreatment: immersion in the aqueous solution as reported in Table 3, then roll squeegee to a wet pick-up of 5 mL/m$^2$
(3) Drying: maximum sheet temperature=40° C., drying time=7 seconds
(4) Chromate treatment: A dispersion of $SiO_2$ in a partially reduced chromic anhydride solution (chromium ratio $Cr^{3+}/Cr^{6+}=0.5$) was used. It contained $Si_{02}$ at a $CrO_3$: $SiO_2$ =1:1 weight ratio based on the total quantity of chromic acid (as $CrO_3$) before reduction. It was applied by roll coating to give a chromium add-on of 55–60 mg/m$^2$.
(5) Drying: maximum sheet temperature=100° C., drying time=10 seconds
(6) Painting: back-surface alkyd paint paint film thickness: 6 micrometers baking conditions: maximum sheet temperature=210° C. drying time=20 seconds
(7) Bending test: Each sample test sheet was subjected to 2T/tape peeling and the extent of peeling was then evaluated and

TABLE 3

| | treatment solution composition (mole/L) | film weight (mg/m$^2$) | bending test | corrosion resistance testing on the painted sheet |
|---|---|---|---|---|
| Example 13 | $NiSO_4$:0.10 | 77.4 | 5 | no abnormality |
| Example 14 | $CoSO_4$:0.05 | 38.7 | 5 | no abnormality |
| Example 15 | $Ni(H_2PO_4)_2$:0.04 | 50.5 | 5 | no abnormality |
| Example 16 | $CoSO_4$:0.07<br>$Ni(H_2PO_4)_2$:0.03 | 92.1 | 5 | no abnormality |
| Example 17 | $Co(H_2PO_4)_2$:0.02<br>Na heptogluconate:0.01 | 25.3 | 4 | no abnormality |
| Example 18 | $NiSO_4$:0.01<br>$CoSO_4$:0.01 | 15.5 | 4 | no abnormality |
| Comparison Ex. 9 | $NiCl_2$:0.05 | 32.4 | 4 | 8D |
| Comparison Ex. 10 | $Co(NO_3)_2$:0.02 | 18.3 | 2 | no abnormality |
| Comparison Ex. 11 | Japanese Patent Application Laid Open Number 59-177381. Example 1-d. (note 1) | (note 2) 8.8 | 4 | 8M |
| Comparison Ex. 12 | no pretreatment | — | 1 | no abnormality |

Note 1: Rinse with tap water after the cobalt treatment.
Note 2: Reported as the cobalt add-on.

reported according to the following evaluation scale:
5: no peeling
4: cracking only or peeled area <5%
3: peeled area=5 to <25%
2: peeled area=25 to <50%
1: peeled area at least 50%

(8) Corrosion resistance testing on the painted sheet: A test specimen (70×150mm) was cut from each sample test sheet and then subjected to the salt-spray test specified in JIS-Z 2371 for 360 hours. The blisters produced on the painted surface of the sheet were evaluated in accordance with the directions from ASTM (American Society for Testing and Materials).

Benefits of the Invention

As the results in Tables 1 through 3 make clear, the results from either black rust accelerated testing or white rust accelerated testing were poor in each of Comparison Examples 1–8. For Comparison Examples 9–12, the results for either bending testing or corrosion resistance testing on the painted sheet were poor. On the other hand, Examples 1–12 according to the present invention afforded excellent results for both black rust accelerated testing and white rust accelerated testing, and Examples 13–18 gave excellent results for both bending testing and corrosion resistance testing on the painted sheets. Thus, through the execution of a chromating treatment on a zinc or zinc alloy surface after it has been pretreated according to the method of the present invention, one obtains the industrially useful effect of a well balanced increase in the blackening resistance, corrosion resistance, post-painting corrosion resistance, and paint adherence.

We claim:

1. A process for forming a protective coating on a zinc surface, comprising a step of applying a chromate treatment to the zinc surface, wherein, prior to applying the chromate treatment to the zinc surface, the zinc surface is pretreated by a process comprising steps of:

(A) covering the zinc surface with a layer of an aqueous solution that consists of (i) water, (ii) at least one $Ni^{2+}$ or $Co^{2+}$ salt, with one of the anions sulfate, $PO_4^{3-}$, $HPO_4^{2-}$, $H_2PO_4^{-}$, $P_2O_7^{-2}$, $HP_2O_7^{-}$, $PO_3^{-}$, and mixtures thereof and, optionally, (iii) a complexing agent; and, without any intervening water rinse,
(B) drying into place on the zinc surface covered in step (A) the solids content of the layer of aqueous solution applied in step (A) by removing the water therefrom at a temperature within the range of 40°-100° C.

2. A process according to claim 1, wherein the layer of aqueous solution applied to the zinc surface in step (A) contains from 0.5 to 100 mg/m$^2$ of the zinc surface of salts selected from the group consisting of sulfate and phosphate salts of $Ni^{2+}$ and $Co^{2+}$ and mixtures thereof.

3. A process according to claim 2, wherein the aqueous solution applied to the zinc surface in step (A) additionally comprises a complexing agent selected from the group consisting of gluconic and heptogluconic acids and their salts.

4. A process according to claim 1, wherein the aqueous solution applied to the zinc surface in step (A) additionally comprises a complexing agent selected from the group consisting of gluconic and heptogluconic acids and their salts.

5. A process according to claim 4, wherein the covering of step (A) is accomplished by roll coating.

6. A process according to claim 3, wherein the covering of step (A) is accomplished by roll coating.

7. A process according to claim 2, wherein the covering of step (A) is accomplished by roll coating.

8. A process according to claim 1, wherein the covering of step (A) is accomplishes by roll coating.

* * * * *